US008579420B2

(12) United States Patent
Yoshida et al.

(10) Patent No.: US 8,579,420 B2
(45) Date of Patent: Nov. 12, 2013

(54) INK-JET APPARATUS

(75) Inventors: Hidehiro Yoshida, Osaka (JP); Kazuki Fukada, Osaka (JP); Keisei Yamamuro, Osaka (JP)

(73) Assignee: Panasonic Corporation, Osaka (JP)

( * ) Notice: Subject to any disclaimer, the term of this patent is extended or adjusted under 35 U.S.C. 154(b) by 266 days.

(21) Appl. No.: 13/047,432

(22) Filed: Mar. 14, 2011

(65) Prior Publication Data

US 2011/0228012 A1 Sep. 22, 2011

(30) Foreign Application Priority Data

Mar. 16, 2010 (JP) ..... 2010-059031
Dec. 9, 2010 (JP) ..... 2010-274678

(51) Int. Cl.
*B41J 2/17* (2006.01)

(52) U.S. Cl.
USPC ..... 347/84

(58) Field of Classification Search
None
See application file for complete search history.

(56) References Cited

U.S. PATENT DOCUMENTS

| | | | | |
|---|---|---|---|---|
| 2005/0088486 | A1 * | 4/2005 | Goin et al. | 347/47 |
| 2006/0082621 | A1 | 4/2006 | Tsukada et al. | |
| 2008/0238980 | A1 | 10/2008 | Nagashima et al. | |

FOREIGN PATENT DOCUMENTS

| | | | |
|---|---|---|---|
| JP | 62-225364 | | 10/1987 |
| JP | 7-251504 | | 10/1995 |
| JP | 2001-121693 | | 5/2001 |
| JP | 2001121693 | A * | 5/2001 |
| JP | 2004-084584 | | 3/2004 |
| JP | 2006-088493 | | 4/2006 |
| JP | 2006-137181 | | 6/2006 |
| JP | 2007-175921 | | 7/2007 |
| JP | 2008-023793 | | 2/2008 |
| JP | 2008-254196 | | 10/2008 |
| JP | 2009-126012 | | 6/2009 |
| JP | 2009-178959 | | 8/2009 |
| JP | 2009-241316 | | 10/2009 |

* cited by examiner

*Primary Examiner* — Matthew Luu
*Assistant Examiner* — Erica Lin
(74) *Attorney, Agent, or Firm* — Panasonic Patent Center

(57) ABSTRACT

An ink-jet apparatus comprising: an ink supply channel through which ink flows; an ink chamber that communicates with the ink supply channel via an ink inlet channel, holds the ink supplied from the ink supply channel, and has a nozzle that discharges the ink; an ink evacuation channel that communicates with the ink chamber via an ink outlet channel, and through which the ink evacuated from the ink chamber flows; an ink circulating section that applies pressure to the ink so that the ink flows into the ink evacuation channel from the ink supply channel via the ink chamber; a first actuator that vibrates a wall of the ink chamber; and a second actuator that changes an area of a cross-section of the ink outlet channel.

10 Claims, 12 Drawing Sheets

INK-JET APPARATUS

CROSS REFERENCE TO RELATED APPLICATIONS

This application is entitled to and claims the benefit of Japanese Patent Application No. 2010-059031 filed on Mar. 16, 2010, and Japanese Patent Application No. 2010-274678 filed on Dec. 9, 2010, the disclosure of which including the specification, drawings and abstract is incorporated herein by reference in its entirety.

TECHNICAL FIELD

The technical field relates to an ink-jet apparatus that discharges ink.

BACKGROUND ART

An ink-jet apparatus is known as an apparatus having a head capable of applying a necessary amount of ink according to an input signal. In particular, piezo (piezoelectric) ink-jet apparatuses are currently objects of active development because of their ability to apply a wide variety of inks under precise control.

A piezo ink-jet apparatus is generally composed of an ink supply channel, a plurality of ink chambers that communicate with the ink supply channel and have a nozzle, and piezoelectric elements that apply pressure to ink loaded in the ink chambers (see Patent Literature 1 through Patent Literature 3 listed below, for example). In an ink-jet apparatus, when a drive voltage is applied to a piezoelectric element, the piezoelectric element is mechanically distorted. By this means, pressure is applied to ink inside an ink chamber, and an ink drop is discharged from a nozzle.

Air may be mixed in with ink inside an ink-jet apparatus, or an ink-jet apparatus nozzle may become clogged, which disables proper ink discharge. Thus, a technology is known whereby an ink-jet apparatus is provided with an ink evacuation channel that communicates with an ink chamber and through which ink evacuated from the ink chamber flows. Then, ink is made to flow from the ink supply channel to the ink evacuation channel using an ink circulating section such as a pump (see Patent Literature 4 listed below, for example).

FIG. 1 is a schematic diagram of an ink-circulating type of ink-jet apparatus disclosed in Patent Literature 4. As shown in FIG. 1, the ink-jet apparatus disclosed in Patent Literature 4 has ink supply channel 10, ink evacuation channel 11, and ink chambers 12A through 12C. Ink chambers 12A through 12C each communicate with ink supply channel 10 and ink evacuation channel 11. That is to say, ink chambers 12A through 12C communicate with ink supply channel 10 via communicating apertures 16A through 16C, and communicate with ink evacuation channel 11 via communicating apertures 17A through 17C. Ink chambers 12A through 12C have actuators 13A through 13C, and nozzles 14A through 14C.

As shown in FIG. 1, ink that is supplied from ink supply aperture 50 and flows through ink supply channel 10 is supplied to each of ink chambers 12A through 12C. Some of the ink supplied to each of ink chambers 12A through 12C is discharged as a droplet through the action of actuators 13A through 13C, and the remaining ink is supplied to ink evacuation channel 11 and evacuated from ink outlet 51.

By making ink flow from an ink supply channel to an ink evacuation channel via the ink chambers in this way, fresh ink is constantly supplied to the ink chambers, and it is possible to prevent air being mixed in with the ink and nozzles becoming clogged.

In the technology of Patent Literature 4, ink circulation pressure is supplied by an ink circulating section such as a pump, but a method is also known whereby a first piezoelectric element and second piezoelectric element are provided, and circulation pressure is supplied to the ink by driving the first piezoelectric element and second piezoelectric element at predetermined timings (see Patent Literature 5 and Patent Literature 6 listed below, for example).

PATENT LITERATURE

PTL 1: Unexamined Japanese Patent Publication No. 2001-121693

PTL 2: Unexamined Japanese Patent Publication No. 07-251504

PTL 3: Unexamined Japanese Patent Publication No. 2008-23793

PTL 4: Unexamined Japanese Patent Publication No. 2009-126012

PTL 5: Unexamined Japanese Patent Publication No. 2007-175921

PTL 6: Unexamined Japanese Patent Publication No. 2004-084584

Technical Problem

However, when an ink evacuation channel that communicates with ink chambers is provided as in Patent Literature 4, force generated by driving of a piezoelectric element escapes into the ink evacuation channel. Consequently, with an ink-circulating type of ink-jet apparatus having an ink evacuation channel, the ratio of ink discharge energy to piezoelectric element drive energy (energy efficiency) decreases. Therefore, an ink-circulating type of ink-jet apparatus requires greater energy in order to discharge ink.

Thus, ink cannot be discharged with high energy efficiency in a conventional ink-circulating type of ink-jet apparatus.

SUMMARY

It is an object of the present embodiments to provide an ink-circulating type of ink-jet apparatus capable of discharging ink with high energy efficiency.

The present inventors found that the above problem can be solved by providing an actuator in an ink outlet channel connecting an ink chamber to an ink evacuation chamber, and controlling the cross-sectional area of the ink outlet channel.

That is to say, the present embodiments relate to the following ink-jet apparatuses.

[1] An ink-jet apparatus comprising: an ink supply channel through which ink flows; an ink chamber that communicates with the ink supply channel via an ink inlet channel, holds the ink supplied from the ink supply channel, and has a nozzle that discharges the ink; an ink evacuation channel that communicates with the ink chamber via an ink outlet channel, and through which the ink evacuated from the ink chamber flows; an ink circulating section that applies pressure to the ink so that the ink flows into the ink evacuation channel from the ink supply channel via the ink chamber; a first actuator that vibrates a wall of the ink chamber; and a second actuator that changes an area of a cross-section of the ink outlet channel.

[2] The ink-jet apparatus described in [1], wherein: the ink chamber comprises: a bottom surface formed by a nozzle plate in which the nozzle is formed; a top surface formed by a ceiling plate opposite the nozzle plate; and a side surface formed by a spacer between the nozzle plate and the ceiling plate; an outlet connecting part that connects the ink outlet channel and the ink chamber and an inlet connecting part that connects the ink inlet channel and the ink chamber are provided at a side surface of the ink chamber; and the outlet connecting part is closer to the nozzle plate than the inlet connecting part is.

[3] The ink-jet apparatus described in [1], wherein: the ink chamber comprises: a bottom surface formed by a nozzle plate in which the nozzle is formed; a top surface formed by a ceiling plate opposite the nozzle plate; and a side surface formed by a spacer between the nozzle plate and the ceiling plate; the ink inlet channel and ink outlet channel are rectilinear; an outlet connecting part that connects the ink outlet channel and the ink chamber and an inlet connecting part that connects the ink inlet channel and the ink chamber are provided at a side surface of the ink chamber; and the inlet connecting part and the outlet connecting part are opposed each other, and a straight passes through the ink inlet channel also passes through the ink outlet channel.

[4] The ink-jet apparatus described in any one of [1] through [3], wherein an area of a cross-section of the ink inlet channel is larger than an area of a cross-section of the ink outlet channel.

[5] The ink-jet apparatus described in any one of [1] through [4], wherein the ink circulating section is a regulator.

[6] The ink-jet apparatus described in any one of [1] through [5], wherein an area of a cross-section of the ink chamber perpendicular to a discharge direction of the ink is larger than an area of a cross-section of the ink inlet channel.

[7] The ink-jet apparatus described in any one of [1] through [6], wherein an area of a cross-section of the ink chamber perpendicular to a discharge direction of the ink is larger than an area of a cross-section of the ink outlet channel.

Advantageous Effects

An ink-jet apparatus of the present embodiment is capable of discharging ink with high energy efficiency despite being an ink-circulating type of ink-jet apparatus.

DESCRIPTION OF EMBODIMENTS

An ink-jet apparatus of the present embodiments is a drop-on-demand type of piezo ink-jet apparatus that has a plurality of ink chambers.

A drop-on-demand ink-jet apparatus can apply a necessary amount of ink according to an input signal. Also, an ink-jet apparatus of the present embodiments is an ink-circulating type of ink-jet apparatus in which ink flows through the ink chambers.

An ink-jet apparatus of the present embodiments has 1) an ink supply channel, 2) ink chambers, 3) an ink evacuation channel, 4) ink inlet channels and ink outlet channels, 5) an ink circulating section, and 6) first actuators and second actuators. The ink-jet apparatus configuration elements are described below.

1) Ink Supply Channel

The ink supply channel is a channel through which ink to be supplied to an ink chamber flows. The ink supply channel may have an ink inlet through which ink is supplied from outside. The amount of the ink that flows through the ink supply channel is not particularly limited, and may be several ml/min or may be greater than this. Ink flowing through the ink supply channel is distributed, and supplied to a plurality of ink chambers.

2) Ink Chambers

An ink chamber is a space for holding ink supplied from the ink supply channel, and communicates with the ink supply channel via an ink inlet channel. An ink chamber and the ink supply channel are connected by means of an ink inlet channel. The maximum number of ink chambers that communicate with one ink supply channel and ink evacuation channel is normally 1024.

An ink chamber has a nozzle for discharging held ink. A nozzle is a discharge aperture that communicates with the outside. One ink chamber may have one nozzle or may have two or more nozzles. Ink inside an ink chamber is discharged to the outside from the nozzle(s). The diameter of a nozzle is not particularly limited but may be in a range of around 10 to 100 μm, for example, with a diameter of approximately 20 μm being one possibility.

Figure 1:
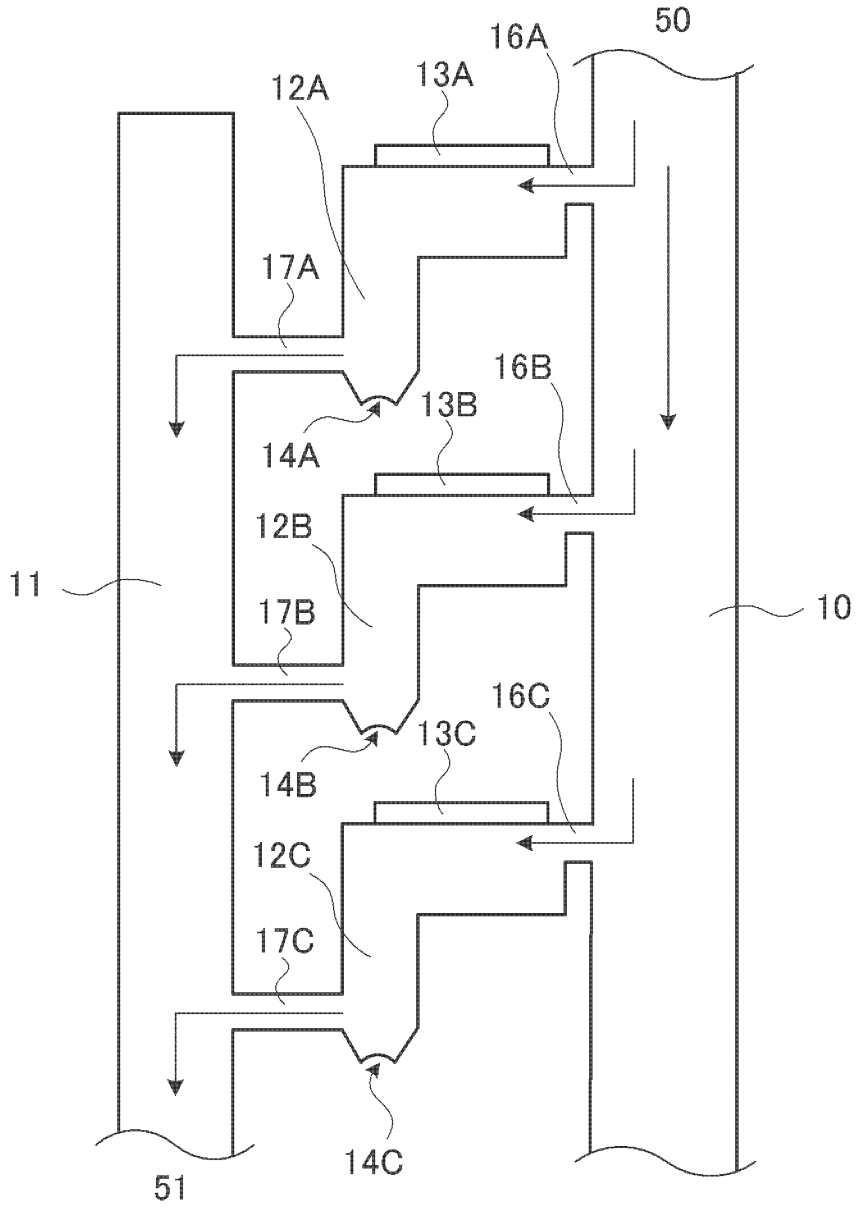
FIG. 1 is a schematic diagram of a conventional ink-jet apparatus.
Figure 2:
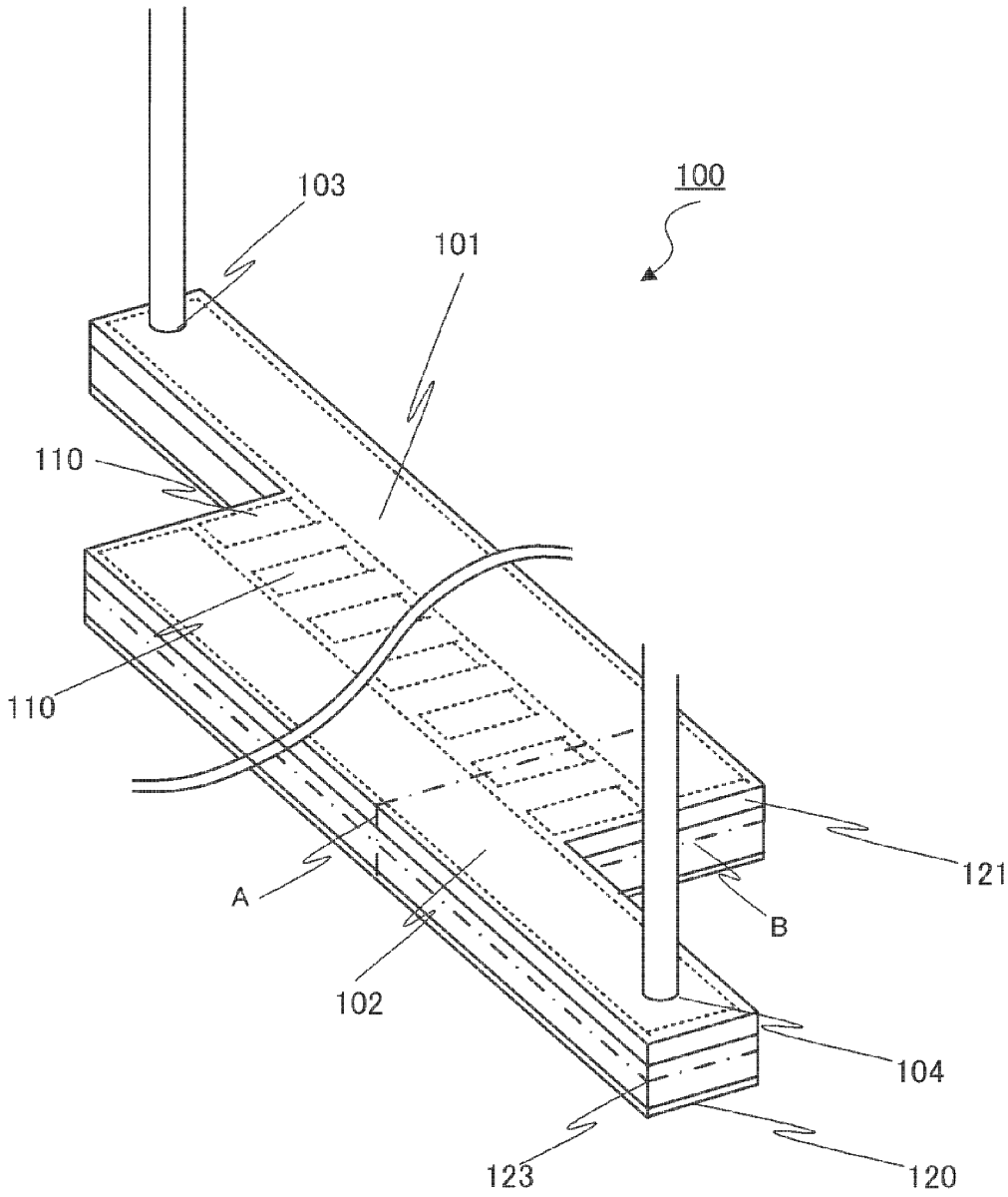
FIG. 2 is a perspective view of an ink-jet apparatus of Embodiment 1.

An ink chamber is fabricated by bonding a nozzle plate forming the bottom surface of the ink chamber, a ceiling plate forming the top surface, and a spacer that is sandwiched between the nozzle plate and ceiling plate and forms a side surface of the ink chamber (see FIG. 2). Here, "a side surface of the ink chamber" means a surface parallel to the ink discharge direction among the wall surfaces of the ink chamber.

3) Ink Evacuation Channel

The ink evacuation channel is a channel that communicates with an ink chamber via an ink outlet channel and through which ink evacuated from an ink chamber flows. An ink chamber and the ink evacuation channel are connected with an ink outlet channel. The ink evacuation channel may have an ink outlet for evacuating ink to the outside.

4) Ink Inlet Channels and Ink Outlet Channels

An ink inlet channel is a channel that connects the ink supply channel to an ink chamber, and an ink outlet channel is a channel that connects an ink chamber to the ink evacuation channel. More specifically, "ink inlet channel" means a region among an ink channel between the ink supply channel and an ink chamber where the area of a cross-section (a cross-section perpendicular to the ink flow direction) (hereinafter also referred to simply as "cross-sectional area") is smallest, and "ink outlet channel" means a region among an ink channel between an ink chamber and the ink evacuation channel where the cross-sectional area is smallest.

An ink inlet channel and ink outlet channel may be curved or rectilinear, but are preferably rectilinear. The reason for this is that, if an ink inlet channel and ink outlet channel are curved, channel resistance of the ink inlet channel and ink outlet channel increases, and it becomes difficult for ink to circulate inside the ink-jet apparatus.

The length of an ink inlet channel is not particularly limited, but may be between 0.5 and 5.0 mm, for example. Similarly, the length of an ink outlet channel is not particularly limited, but may be between 0.5 and 4.0 mm, for example.

Figure 3:
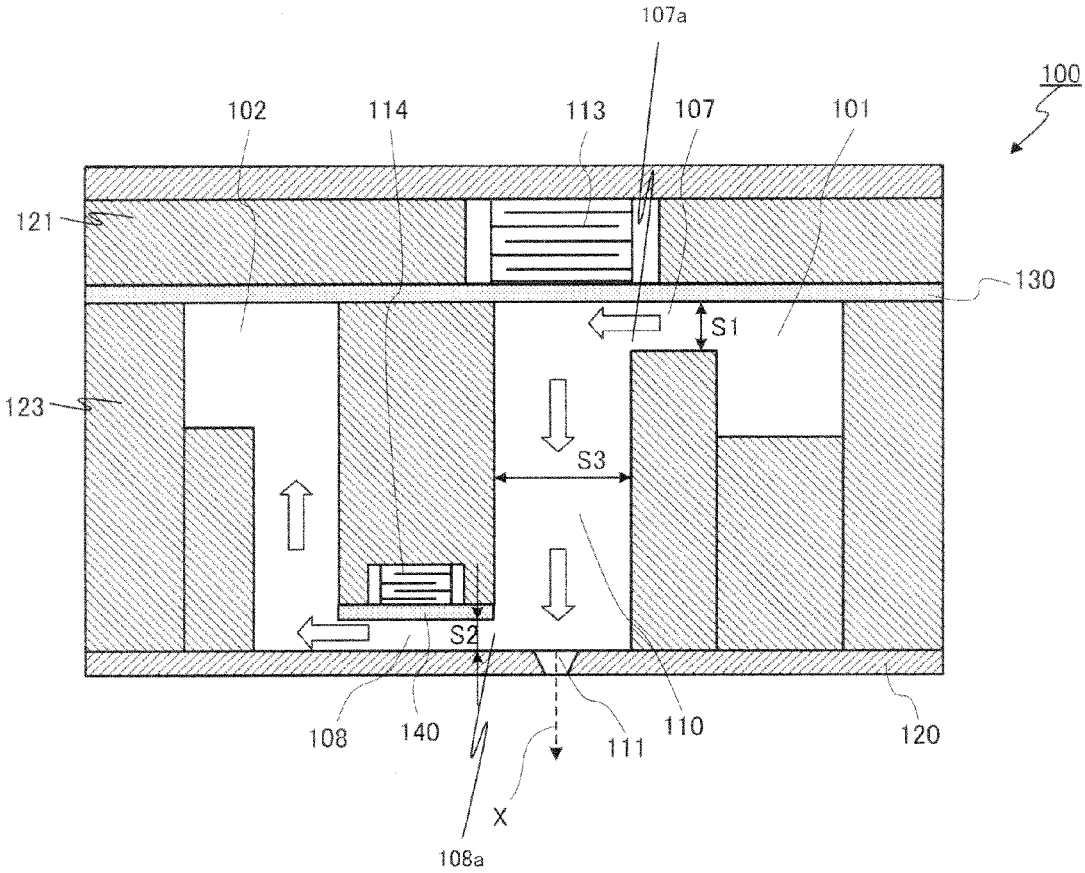
FIG. 3 is a cross-sectional view of an ink-jet apparatus of Embodiment 1.

The cross-sectional area of an ink outlet channel may be the same as the cross-sectional area of an ink inlet channel, but it is desirable that the cross-sectional area of an ink outlet channel be smaller than the cross-sectional area of an ink inlet channel (see FIG. 3). Specifically, it is desirable that the cross-sectional area of an ink inlet channel be between 1000 and 7500 $\mu m^2$, the cross-sectional area of an ink outlet channel be between 500 and 5000 $\mu m^2$, and the cross-sectional area of an ink outlet channel be between 500 and 3000 $\mu m^2$ smaller than the cross-sectional area of an ink inlet channel.

Making the cross-sectional area of an ink outlet channel smaller in this way makes it easier for the cross-sectional area of an ink outlet channel to be decreased by a second actuator described later herein. Also, making the cross-sectional area of an ink outlet channel smaller than the cross-sectional area of an ink inlet channel enables the channel resistance of an ink outlet channel to be made greater than the channel resistance of an ink inlet channel. By this means, reverse flow of ink from an ink outlet channel into an ink chamber can be prevented (see Embodiment 1).

It is also desirable that the cross-sectional area of an ink inlet channel be smaller than the area of a cross-section of an ink chamber perpendicular to the discharge direction of ink (hereinafter also referred to simply as "cross-sectional area of an ink chamber" or "ink chamber cross-sectional area"). Making the cross-sectional area of an ink chamber larger than the cross-sectional area of an ink inlet channel in this way makes the channel resistance of an ink chamber smaller than the channel resistance of an ink inlet channel, enabling ink to be supplied smoothly from an ink inlet channel to an ink chamber.

It is desirable that a connecting part that connects an ink chamber and an ink inlet channel (hereinafter also referred to as "inlet connecting part") and a connecting part that connects an ink chamber and ink outlet channel (hereinafter also referred to as "outlet connecting part") be provided at a side surface of an ink chamber. Providing an inlet connecting part and outlet connecting part at a side surface of an ink chamber makes it more difficult for discharge-direction force generated by a first actuator described later herein to escape into an ink inlet channel and ink outlet channel, thus, ink can be discharged with great force.

On the other hand, if an inlet connecting part and outlet connecting part are provided at the bottom surface (nozzle plate) of an ink chamber, for example, rather than at a side surface of an ink chamber, force in the discharge direction (direction toward nozzle plate) generated by a first actuator will escape into an ink inlet channel and ink outlet channel, and the ink discharge force will be weakened.

There are no particular limitations on the relative positional relationship of an inlet connecting part and outlet connecting part. For example, an outlet connecting part may be closer to the nozzle plate than an inlet connecting part is (see Embodiments 1 through 3), or an inlet connecting part and outlet connecting part may be opposite to each other (see Embodiments 4 and 5).

5) Ink Circulating Section

The ink circulating section applies pressure to ink so that the ink flows from the ink supply channel to the ink evacuation channel via the ink chambers. That is to say, in the present embodiments, ink flows through the ink supply channel, ink inlet channels, ink chambers, ink outlet channels, and ink evacuation channel, in that order. Consequently, in the present embodiments, fresh ink is constantly supplied to the ink chambers. Constantly supplying fresh ink to the ink chambers in this way enables ink stagnation or blockages inside the ink chambers, and mixing of air in with the ink, to be prevented. It is desirable that the ink flow rate inside an ink chamber be between 10 and 100 ml/min. With an ink-jet apparatus of the present embodiments, it is desirable that ink in the ink-jet apparatus be continuously circulated while the apparatus is operating.

While a pump may be used to supply pressure to the ink, it is desirable that a regulator that supplies pressure utilizing compressed air be used. The reason for this is that using a regulator enables the drive pressure to be kept constant, and the ink circulation speed to be kept stable.

The type of ink held in an ink chamber is not particularly limited, and can be selected as appropriate according to the type of product. For example, when the product is an organic EL panel or liquid crystal panel, examples of the ink held in an ink chamber include a high-viscosity ink such as a solution containing an organic light-emitting material or another similar luminescent material. As stated above, an ink-jet apparatus of the present embodiments has great discharge force, enabling adequate application to be achieved even with high-viscosity ink.

6) First Actuators and Second Actuators

A first actuator and a second actuator are actuators that convert a control signal containing a drive voltage into an actual movement.

An actuator in the present embodiments may be a thin-film piezoelectric element or may be a laminated piezoelectric element, but a laminated piezoelectric element is preferable. The reason for this is that, although the output response of a thin-film piezoelectric element with respect to input is fast, its output tends to be low. Consequently, thin-film piezoelectric element driving is apt to vary according to the viscosity of ink that is to be discharged.

On the other hand, a laminated piezoelectric element has slow output response with respect to input, but its output is readily increased. Consequently, a laminated piezoelectric element tends not to be affected by the viscosity of ink that is to be discharged, and can achieve stable driving. The height (lamination-direction length) of a laminated piezoelectric element is normally between 100 and 1000 μm.

A laminated piezoelectric element can be fabricated by laminating a plurality of piezoelectric zirconate titanate (PZT) sheets and conductive films on a piezoelectric plate to fabricate a driver, and then dividing the driver. A dicing apparatus incorporating a rotating blade can be used to divide the driver.

A first actuator vibrates a wall of an ink chamber, thereby controlling pressure inside the ink chamber. By this means, an ink chamber is replenished with ink, and ink inside the ink chamber is discharged from the nozzle. The wall of an ink chamber to be vibrated by the first actuator may be the top surface of the ink chamber (see Embodiment 1), or may be a side surface of the ink chamber (see Embodiments 2 and 3).

Also, the wall of an ink chamber to be vibrated by the first actuator may be a vibration plate (diaphragm). Furthermore, the top surface of the first actuator may form a wall of an ink chamber.

A second actuator changes the cross-sectional area of an ink outlet channel. More specifically, a second actuator decreases the cross-sectional area of an ink outlet channel. The structure of a second actuator may be the same as the structure of a first actuator, or may be different. For example, the ratio of expansion and contraction of a second actuator when driven may be smaller than the ratio of expansion and contraction of a first actuator when driven.

The timing for driving a second actuator may be the same as the timing for driving a first actuator, or may be different. That is to say, a second actuator may begin to decrease the cross-sectional area of an ink outlet channel at the same time as a first actuator begins to apply pressure to ink in an ink chamber, or a second actuator may begin to decrease the cross-sectional area of an ink outlet channel at a different point in time from that at which a first actuator begins to apply pressure to ink in an ink chamber.

If the first actuator and the second actuator are driven at different timings, it is desirable that the second actuator be driven before the first actuator. That is to say, it is desirable that the cross-sectional area of the ink outlet channel begins to be decreased before pressure begins to be applied to ink in the ink chamber.

When the cross-sectional area of the ink outlet channel is decreased before pressure is applied to ink in the ink chamber in this way, it is possible to suppress the escape of force generated by driving the first actuator into the ink evacuation channel via the ink outlet channel, and to suppress loss of first actuator drive energy. Therefore, an ink-jet apparatus and ink discharge method of the present embodiments enable discharge to be performed with high energy efficiency even with high-viscosity ink.

In addition to being equipped with the above-described main configuration members, an ink-jet apparatus of the present invention also has a member of a known ink-jet apparatus as appropriate. For example, an ink-jet apparatus of the present invention has a movable stage for mounting and moving an object to which ink is to be applied.

Now, embodiments will be described with reference to the accompanying drawings. However, the scope of these embodiments are not to be limited to the exemplary descriptions.

Embodiment 1

FIG. 2 is a perspective view of ink-jet apparatus 100 of Embodiment 1. As shown in FIG. 2, ink-jet apparatus 100 has ink supply channel 101, ink evacuation channel 102, and a plurality of ink chambers 110. In addition, ink-jet apparatus 100 has an ink circulating section (not shown). Ink supply channel 101 has ink inlet 103, and ink evacuation channel 102 has ink outlet 104.

Ink-jet apparatus 100 is formed by bonding nozzle plate 120 in which nozzles 111 are formed, spacer 123, and ceiling plate 121.

Figure 4:
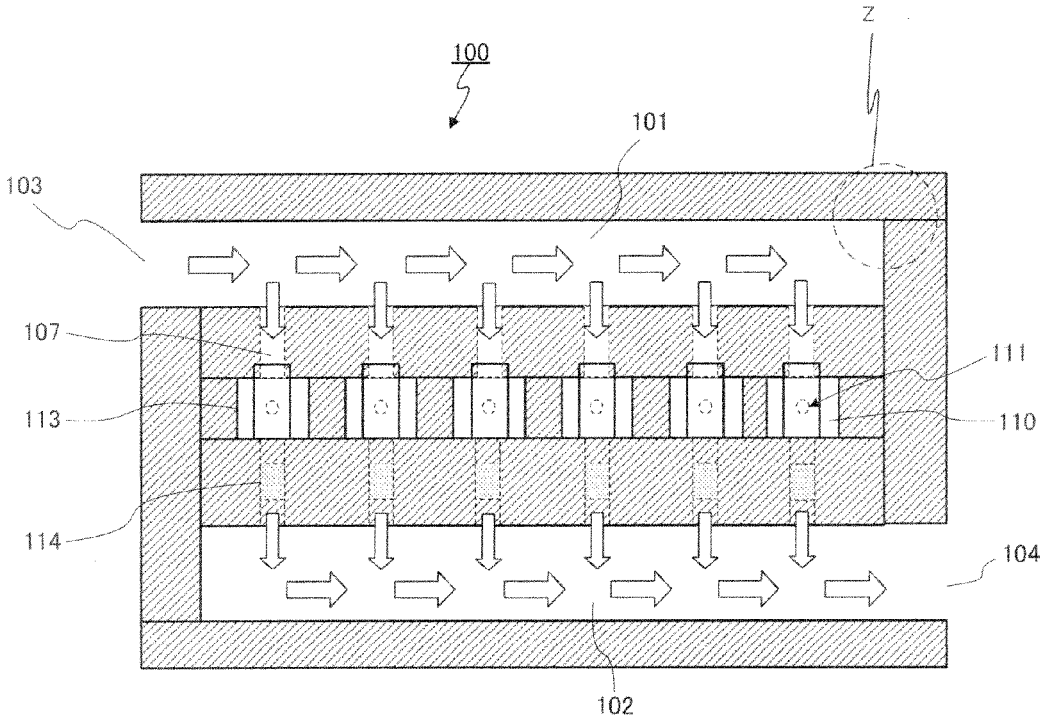
FIG. 4 is a cross-sectional view of an ink-jet apparatus of Embodiment 1.

FIG. 3 is a cross-sectional view of ink-jet apparatus 100 shown in FIG. 2 taken along line A, and FIG. 4 is a cross-sectional view of ink-jet apparatus 100 shown in FIG. 2 taken along line B (top view). The arrows in FIG. 3 and FIG. 4 indicate the direction of the ink flow.

As shown in FIG. 3 and FIG. 4, ink-jet apparatus 100 also has ink chambers 110, ink inlet channels 107, ink outlet channels 108, first actuators 113, and second actuators 114.

Figure 5A:
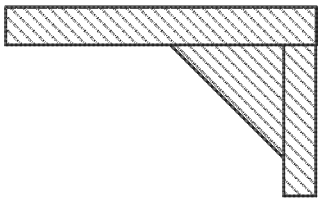
FIG. 5 is a drawing showing partial enlargements of a cross-section of an ink-jet apparatus of Embodiment 1.
Figure 5B:
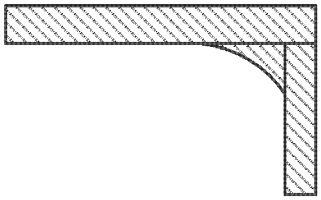

FIG. 5A is an enlarged drawing of area Z indicated in FIG. 4. As shown in FIG. 5A, it is desirable that the most downstream section of ink supply channel 101 be tapered. Also, a corner of the most downstream section of ink supply channel 101 may be curved (FIG. 5B). By tapering the most downstream section of ink supply channel 101 in this way, ink can be prevented from accumulating in the most downstream section of ink supply channel 101.

Ink chambers 110 have a bottom surface formed by nozzle plate 120 in which nozzles 111 are formed, a side surface formed by spacer 123, and a top surface formed by ceiling plate 121. Ink chambers 110 communicate with ink supply channel 101 via ink inlet channels 107, and communicate with ink evacuation channel 102 via ink outlet channels 108. Ink inlet channels 107 and ink outlet channels 108 are rectilinear channels that do not curve.

Inlet connecting part 107*a* that connects ink chamber 110 and ink inlet channel 107, and outlet connecting part 108*a* that connects ink chamber 110 and ink outlet channel 108, are provided at a wall of the ink chamber. In this embodiment, outlet connecting part 108*a* is closer to nozzle plate 120 than inlet connecting part 107*a* is.

Cross-sectional area S3 of ink chamber 110 (the area of a cross-section perpendicular to ink discharge direction X) is larger than cross-sectional area S1 of ink inlet channel 107. Also, cross-sectional area S2 of ink outlet channel 108 is smaller than cross-sectional area S1 of ink inlet channel 107. Therefore, in this embodiment, the following expression holds true:

$$S3>S1>S2$$

First actuator 113 vibrates a wall of ink chamber 110. Specifically, in this embodiment, first actuator 113 vibrates vibration plate 130 forming the top surface of ink chamber 110.

Second actuator 114 decreases the cross-sectional area of ink outlet channel 108. Specifically, in this embodiment, second actuator 114 vibrates vibration plate 140 forming the top surface of ink outlet channel 108.

Next, the operation of ink-jet apparatus 100 of this embodiment will be described with reference to FIG. 3 and FIG. 4.

First, ink is supplied to ink supply channel 101 from an ink tank (not shown). It is desirable that the ink tank have a pressure regulating mechanism (not shown). Providing the ink tank with a pressure regulating mechanism enables ink to be supplied from the ink tank to ink supply channel 101 at constant pressure even if ink in the ink tank is consumed and the ink level in the ink tank falls. The pressure regulating mechanism may also keep the pressure of supplied ink constant by regulating the height of the ink tank and keeping the height of the ink level constant.

Ink flowing in the ink supply channel 101 is supplied to ink chamber 110 via ink inlet channel 107. Ink supplied to ink chamber 110 is further evacuated into ink evacuation channel 102 via ink outlet channel 108. Consequently, ink flows through the interior of ink chamber 110 from inlet connecting part 107*a* to outlet connecting part 108*a*. By this means, fresh ink is constantly supplied to ink chamber 110.

Cross-sectional area S3 of ink chamber 110 is larger than cross-sectional area S1 of ink inlet channel 107. Consequently, the channel resistance of ink chamber 110 is lower than the channel resistance of ink inlet channel 107, and therefore ink is supplied smoothly from ink inlet channel 107 to ink chamber 110.

Also, in this embodiment, outlet connecting part is closer to the nozzle than inlet connecting part 107*a* is. Consequently, in this embodiment, the direction in which ink flows inside ink chamber 110 is the same as direction X in which ink is discharged from nozzle 111 (discharge direction X). Consequently, a force in the same direction as discharge direction X acts beforehand on ink in ink chamber 110.

Next, a drive voltage is applied to first actuator 113. As a result, first actuator 113 expands, vibration plate 130 is pressed in ink discharge direction X by first actuator 113, and the volume of ink chamber 110 decreases. By this means, discharge-direction-X pressure is applied to the ink in ink chamber 110.

At this time, a drive voltage is also applied to second actuator 114. The timing at which a drive voltage is applied to second actuator 114 may be the same as for first actuator 113, or may be different. When the drive voltage is applied to second actuator 114, vibration plate 140 is pressed by second actuator 114, and cross-sectional area S2 of ink outlet channel 108 decreases. As a result of the decrease in cross-sectional area S2 of ink outlet channel 108, the channel resistance of ink outlet channel 108 increases.

By driving second actuator 114 and increasing the channel resistance of ink outlet channel 108 when first actuator 113 is driven in this way, it is possible to suppress the escape of force generated by driving of first actuator 113 into ink evacuation channel 102 via ink outlet channel 108. By this means, force generated by driving of first actuator 113 can be converted efficiently to ink discharge force. As a result, loss of first actuator 113 drive energy can be suppressed, and ink can be discharged with great force.

Also, in this embodiment, since ink flows in discharge direction X inside ink chamber 110, a force in the same direction as discharge direction X acts beforehand on ink in the ink chamber 110. Consequently, ink in the ink chamber 110 is discharged by a force combining X-direction force acting on the ink beforehand and force generated by driving of first actuator 113. Thus, in this embodiment, the force of ink flowing inside ink chamber 110 can be utilized as ink discharge force, enabling ink to be discharged with greater force.

When the first actuator 113 drive voltage is released after ink discharge, the first actuator contracts, and the volume of ink chamber 110 increases. When the volume of ink chamber 110 increases, the pressure inside ink chamber 110 falls, and ink is supplied to the interior of ink chamber 110. As stated above, cross-sectional area S2 of ink outlet channel 108 is smaller than cross-sectional area S1 of ink inlet channel 107. Consequently, the channel resistance of ink inlet channel 107 is lower than the channel resistance of ink outlet channel 108, ink is supplied to ink chamber 110 only from ink inlet channel 107, and ink does not flow back into ink chamber 110 from ink outlet channel 108. It is desirable that the difference between the pressure inside the ink inlet channel and the pressure inside the ink outlet channel of each ink chamber be constant. However, if ink flows back into ink chamber 110 from ink outlet channel 108, the difference between the pressure inside the ink inlet channel and the pressure inside the ink outlet channel of each ink chamber will vary among the ink chambers, and there will be variation in the amounts of ink discharged from the nozzles of ink chambers 110.

Embodiment 2

In Embodiment 1, an example was described in which a first actuator vibrates the top surface of an ink chamber. In Embodiment 2, an example will be described in which a first actuator vibrates a side surface (a surface parallel to the ink discharge direction) of an ink chamber.

Figure 6A:
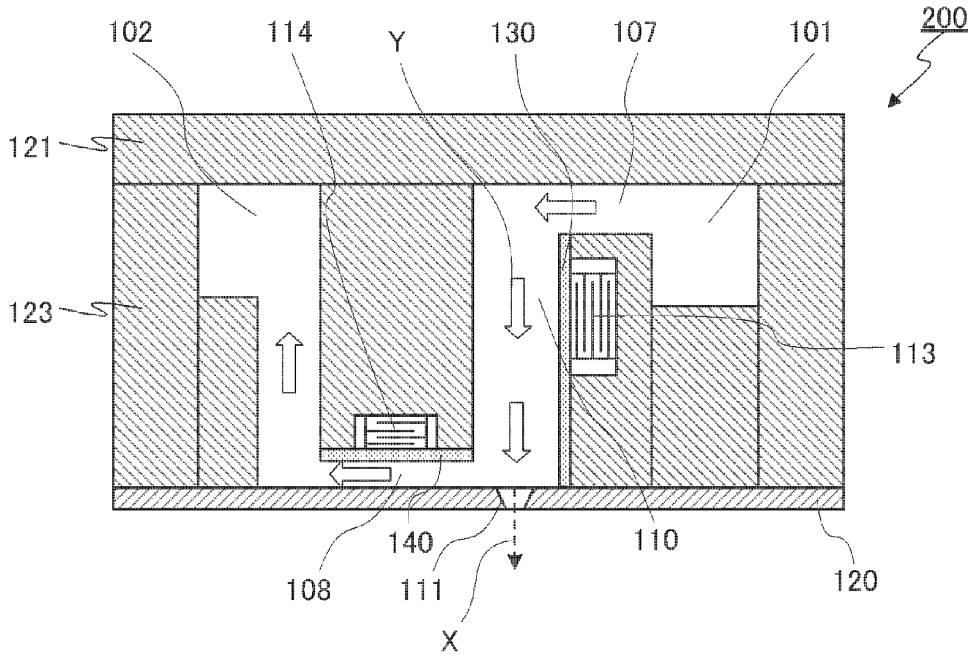
FIG. 6 is a drawing showing cross-sectional views of an ink-jet apparatus of Embodiment 2.
Figure 6B:
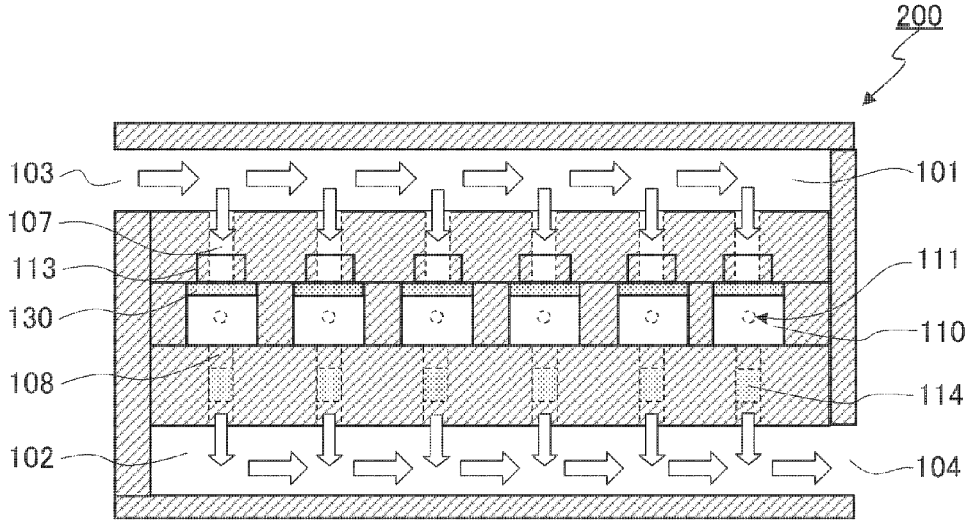

FIG. 6A is a cross-sectional view of ink-jet apparatus 200 of this embodiment taken along line A (see FIG. 2), and FIG. 6B is a cross-sectional view of ink-jet apparatus 200 of this embodiment taken along line B (see FIG. 2).

As shown in FIG. 6A, ink-jet apparatus 200 of this embodiment is the same as ink-jet apparatus 100 of Embodiment 1 except that the first actuator 113 is provided so as to vibrate an ink chamber 110 side surface in the vicinity of ceiling plate 121.

Also, in this embodiment, the ink chamber 110 side surface that is vibrated by first actuator 113 is formed by vibration plate 130. Furthermore, the direction in which first actuator 113 expands is the same as direction Y in which ink flows inside ink inlet channel 107.

With ink-jet apparatus 100 in which first actuator 113 vibrates the top surface of ink chamber 110 and ink inlet channel 107 is provided in the vicinity of the top surface of ink chamber 110, as in Embodiment 1, some of the force generated by driving of first actuator 113 tends to escape into ink inlet channel 107.

On the other hand, when first actuator 113 vibrates an ink chamber 110 side surface to which ink inlet channel 107 is connected, as in this embodiment, force generated by driving of first actuator 113 has a vector in the opposite direction to ink inlet channel 107. Consequently, when first actuator 113 vibrates an ink chamber 110 side surface to which ink inlet channel 107 is connected, force generated by driving of first actuator 113 does not tend to escape into ink inlet channel 107.

Thus, in this embodiment, the escape of force generated by driving of first actuator 113 into ink inlet channel 107 can be prevented, and loss of first actuator 113 drive energy can be suppressed.

Embodiment 3

In Embodiment 2, a mode was described in which first actuators 113 vibrate an area in the vicinity of the ceiling plate among the side surfaces of ink chambers. In Embodiment 3, a mode will be described in which first actuator 113 vibrates an ink chamber side surface area in the vicinity of the nozzle plate.

Figure 7:
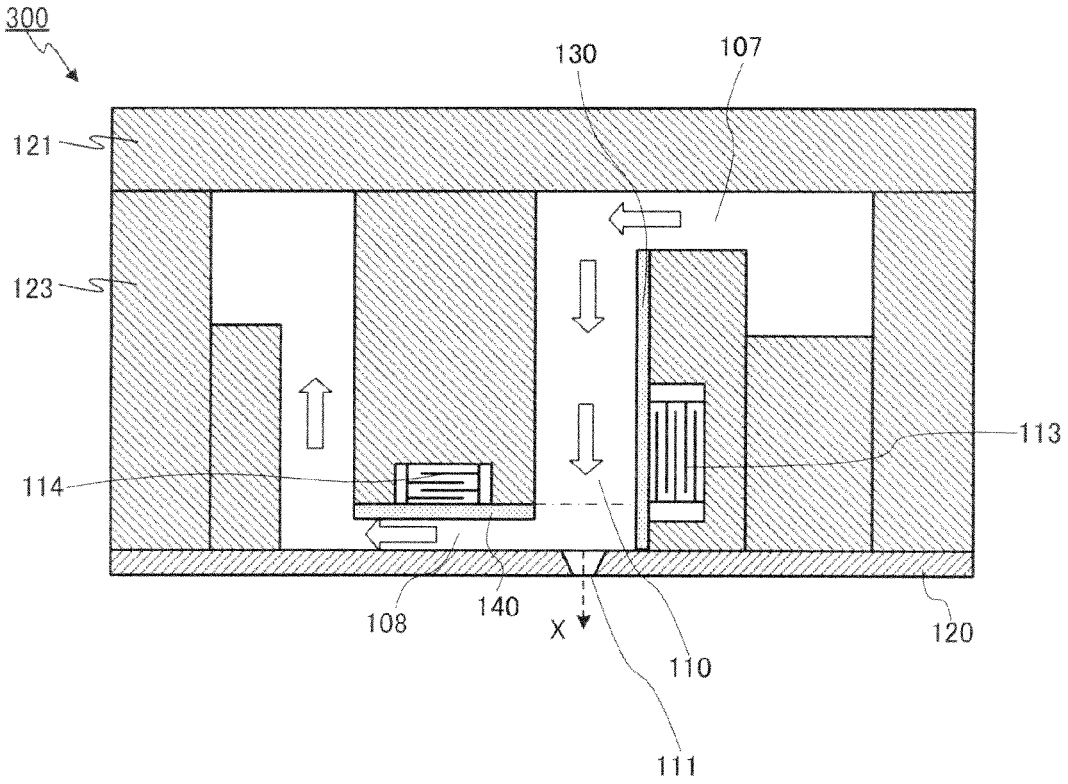
FIG. 7 is a cross-sectional view of an ink-jet apparatus of Embodiment 3.

FIG. 7 is a cross-sectional view of ink-jet apparatus 300 of Embodiment 3. As shown in FIG. 7, ink-jet apparatus 300 of Embodiment 3 is the same as the ink-jet apparatus 200 of Embodiment 2 except that first actuator 113 vibrates an ink chamber 110 side surface area in the vicinity of nozzle plate 120.

Thus, in this embodiment, the distance between first actuator 113 and nozzle 111 is short, and therefore the time taken for a force generated by driving of first actuator 113 to be transferred to nozzle 111 is short. Consequently, the time lag between driving of first actuator 113 and ink discharge from nozzle 111 is decreased, and the ink discharge responsiveness of the ink-jet apparatus is improved.

Also, since the distance between first actuator 113 and nozzle 111 is short, a force generated by driving of first actuator 113 is transferred to nozzle 111 without attenuation. This makes it possible to discharge ink with great force.

Thus, according to this embodiment, in addition to the provision of the effects of Embodiment 2, an improvement in ink discharge responsiveness and a further improvement in ink discharge force can be expected.

Embodiment 4

In Embodiments 1 through 3, modes have been described in which an outlet connecting part is closer to the nozzle than an inlet connecting part is. In Embodiment 4, a mode will be described in which an inlet connecting part and outlet connecting part are disposed opposite to each other.

Figure 8A:
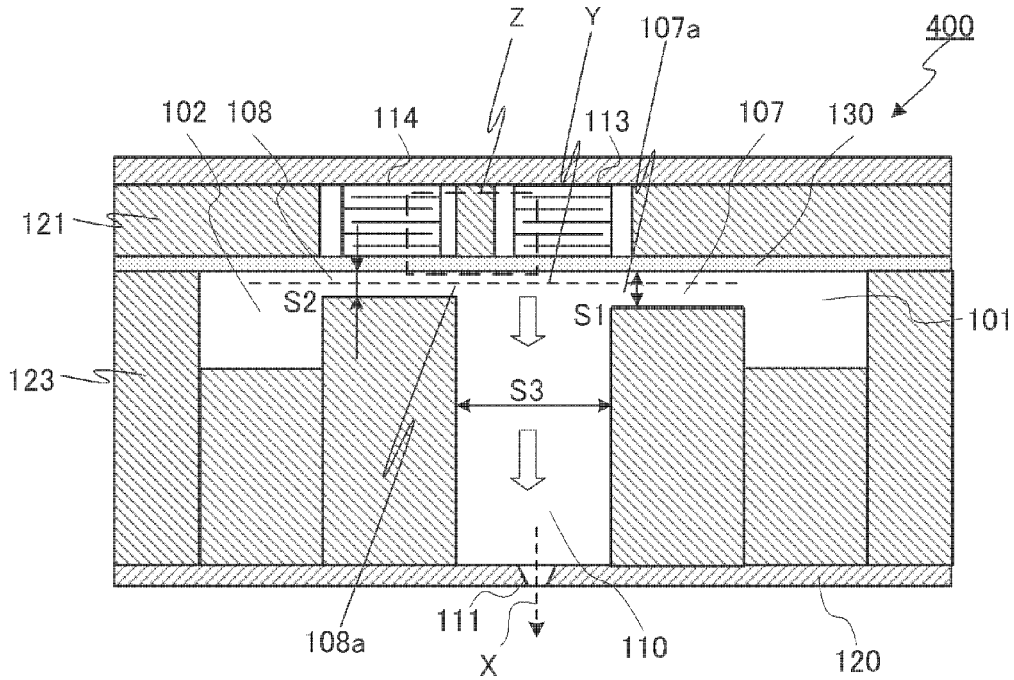
FIG. 8 is a drawing showing cross-sectional views of an ink-jet apparatus of Embodiment 4.
Figure 8B:
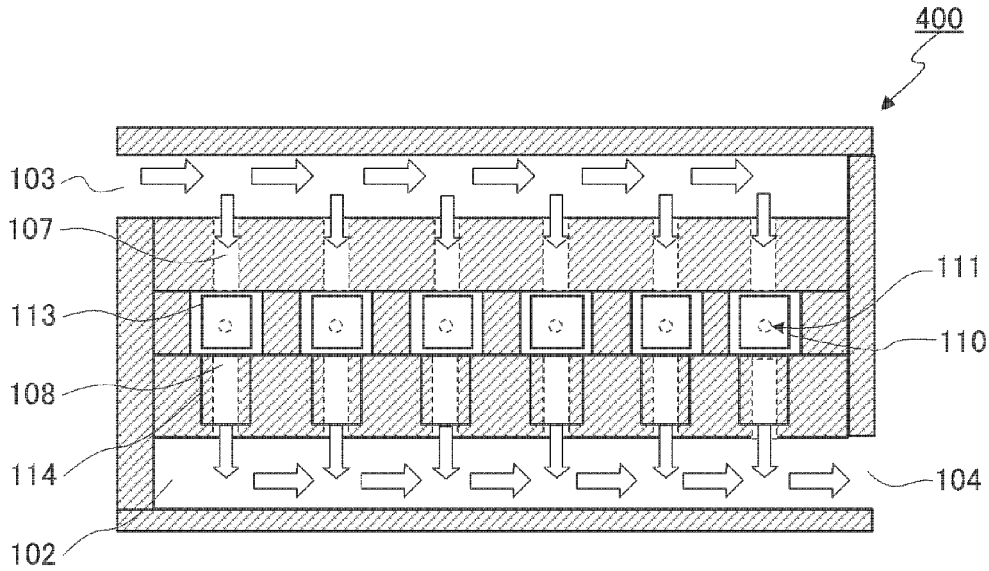

FIG. 8A is a cross-sectional view of ink-jet apparatus 400 of Embodiment 4 taken along line A (see FIG. 2), and FIG. 8B is a cross-sectional view of ink-jet apparatus 400 of Embodiment 4 taken along line B (see FIG. 2).

As shown in FIG. 8A and FIG. 8B, in ink-jet apparatus 400, inlet connecting part 107*a* and outlet connecting part 108*a* are disposed opposite to each other. Also, inlet connecting part 107*a* and outlet connecting part 108*a* are positioned in the vicinity of the top surface.

In this embodiment, ink inlet channel 107 and ink outlet channel 108 are rectilinear channels that do not curve. Furthermore, straight line Y passing through ink inlet channel 107 also passes through ink outlet channel 108.

Having ink inlet channel 107 and ink outlet channel 108 positioned in the same line in this way enables the smooth flow of ink from ink inlet channel 107 to ink outlet channel 108. As a result, the circulation of ink inside the ink-jet apparatus becomes smoother, and ink can be circulated within the ink-jet apparatus with a low circulation pressure even when high-viscosity ink is supplied.

On the other hand, when the flow of ink from ink inlet channel 107 to ink outlet channel 108 is smooth, there is a risk of ink accumulating in the vicinity of the nozzle of ink chamber 110. However, in this embodiment, cross-sectional area S2 of ink outlet channel 108 is smaller than cross-sectional area S3 of ink chamber 110, and the channel resistance of ink outlet channel 108 is greater than the channel resistance of ink chamber 110. Consequently, ink flowing from ink inlet channel 107 to ink chamber 110 flows into ink outlet channel 108 after circulating inside ink chamber 110. As a result, in this embodiment, ink does not accumulate inside ink chamber 110.

Also, in this embodiment, first actuator 113 and second actuator 114 vibrate the same vibration plate 130.

Figure 9A:
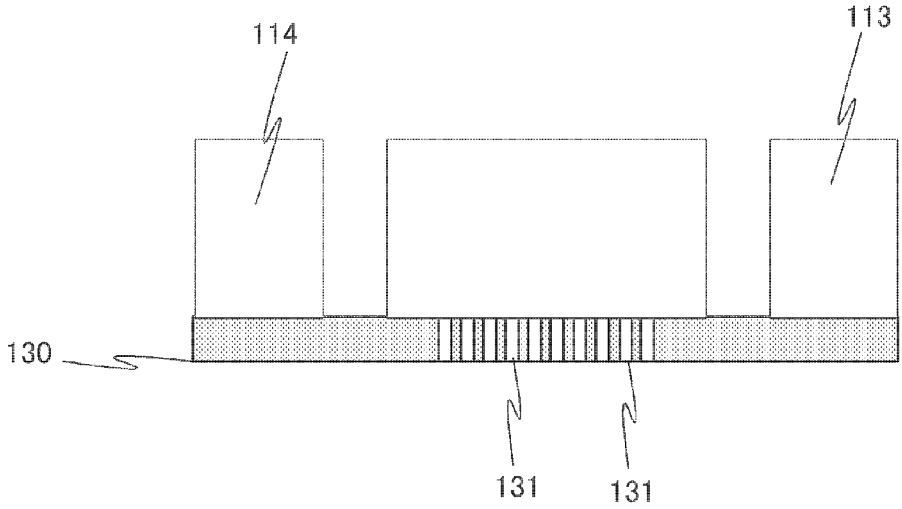
FIG. 9 comprises drawings showing a vibration plate of an ink-jet apparatus of Embodiment 4.

FIG. 9A is an enlarged drawing of the area of the ink-jet apparatus enclosed by rectangle Z in FIG. 8A. As shown in FIG. 9A, a plurality of punch holes 131 are formed in an area of vibration plate 130 between first actuator 113 and second actuator 114.

Figure 9B:
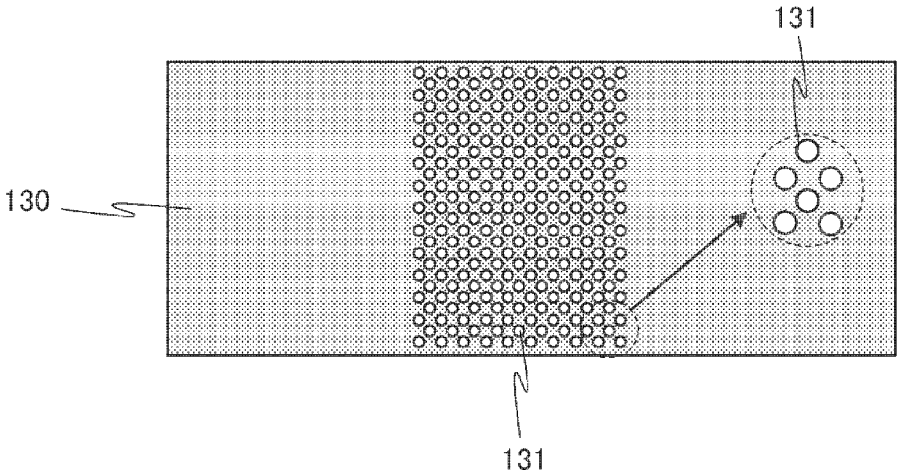
Figure 9C:
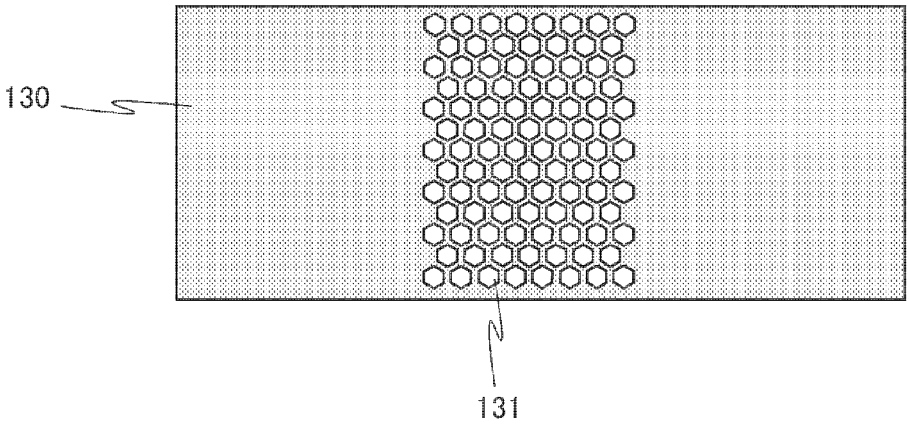

Punch holes 131 are arranged in a regular manner in the area of vibration plate 130 between first actuator 113 and second actuator 114 (see FIG. 9B and FIG. 9C). Punch holes 131 may be circular (FIG. 9B) or may be hexagonal (FIG. 9C). Making punch holes 131 hexagonal enables them to be arranged in a honeycomb pattern, and to be arranged densely in vibration plate 130.

As a result of forming punch holes 131 in an area of vibration plate 130 between first actuator 113 and second actuator 114 in this way, vibration generated by driving of first actuator 113 is cut off by punch holes 131, and is impeded from reaching the second actuator 114 side. By this means, interference between first actuator 113 and second actuator 114 can be reduced, and it is possible to control each actuator with a high degree of precision even when first actuator 113 and second actuator 114 vibrate the same vibration plate 130.

Thus, according to this embodiment, smoother circulation is made possible, enabling impurities in the ink and nozzle clogging to be suppressed more effectively.

Also, in this embodiment, first actuator 113 and second actuator 114 are provided on the ceiling plate, allowing simple construction of an ink-jet apparatus of this embodiment.

Furthermore, in this embodiment, an inlet connecting part and outlet connecting part are not positioned at a side surface of an ink chamber in the vicinity of the nozzle plate as in Embodiments 1 through 3, enabling the nozzle plate and spacer to be strongly bonded, and the rigidity of the nozzle plate to be increased.

Embodiment 5

In Embodiment 4, an example was described in which a first actuator vibrates the top surface of an ink chamber. In Embodiment 5, an example will be described in which a first actuator vibrates a side surface (a surface parallel to the ink discharge direction) of an ink chamber.

Figure 10A:
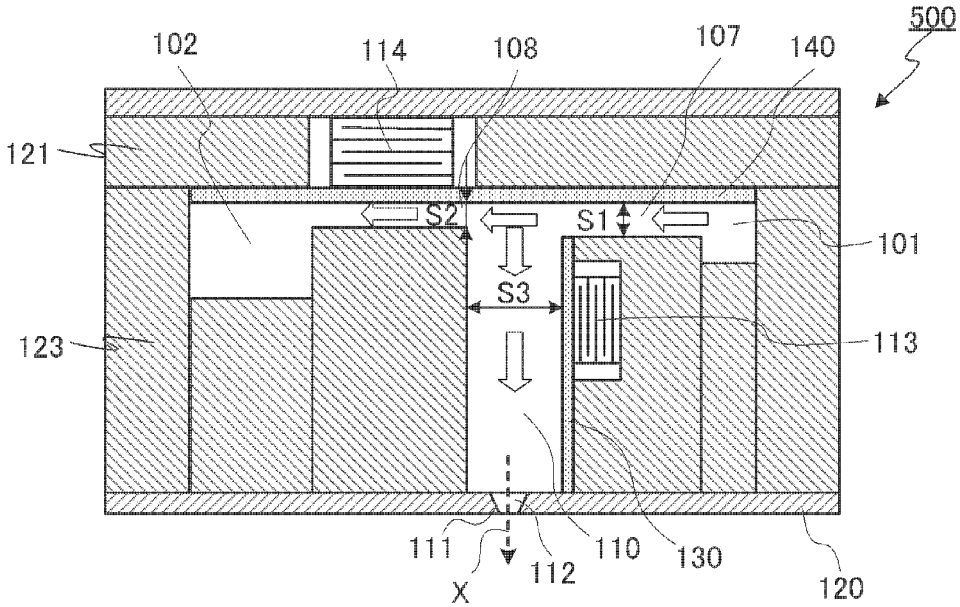
FIG. 10 is a drawing showing cross-sectional views of an ink-jet apparatus of Embodiment 5.
Figure 10B:
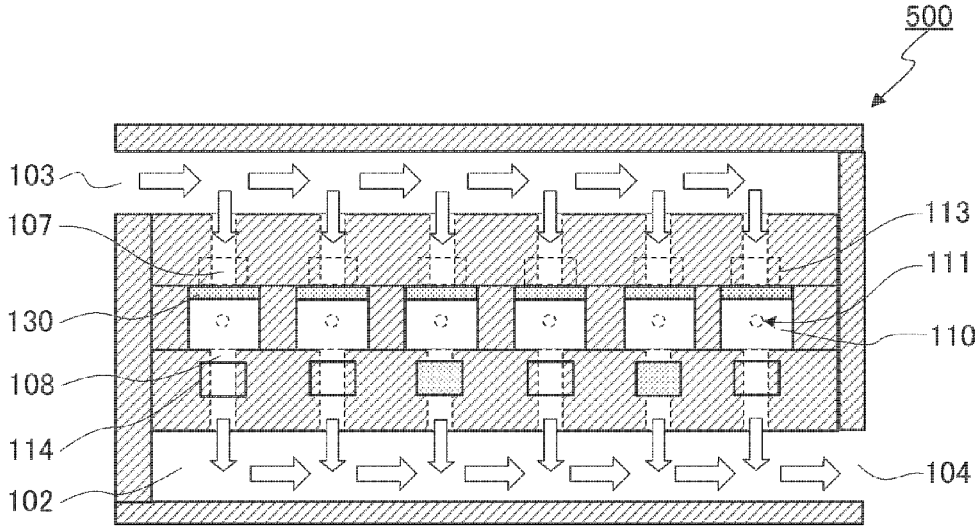

FIG. 10A is a cross-sectional view of ink-jet apparatus 500 of Embodiment 5 taken along line A (see FIG. 2), and FIG. 10B is a cross-sectional view of ink-jet apparatus 500 of Embodiment 5 taken along line B (see FIG. 2).

As shown in FIG. 10A and FIG. 10B, ink-jet apparatus 500 is the same as ink-jet apparatus 400 of Embodiment 4 except that first actuator 113 is provided so as to vibrate a side surface of ink chamber 110. The ink chamber 110 side surface that is vibrated by first actuator 113 is formed by vibration plate 130. The direction in which first actuator 113 expands is the same as the direction in which ink flows inside ink inlet channel 107.

With ink-jet apparatus 400 in which first actuator 113 vibrates the top surface of ink chamber 110 and ink inlet channel 107 is provided in the vicinity of the top surface of ink chamber 110, as in Embodiment 4, some of the force generated by driving of first actuator 113 tends to escape into ink inlet channel 107.

On the other hand, when first actuator 113 vibrates an ink chamber 110 side surface to which ink inlet channel 107 is connected, as in this embodiment, force generated by driving of first actuator 113 has a vector in the opposite direction to ink inlet channel 107. Consequently, when first actuator 113 vibrates an ink chamber 110 side surface to which ink inlet channel 107 is connected, force generated by driving of first actuator 113 does not tend to escape into ink inlet channel 107.

Thus, in this embodiment, the escape of force generated by driving of first actuator 113 into ink inlet channel 107 can be prevented, and ink can be discharged with greater force.

Embodiment 6

In Embodiments 1 through 5, modes have been described in which the channel widths of an ink supply channel and ink evacuation channel are constant. In Embodiment 6, a mode will be described in which the channel widths of an ink supply channel and ink evacuation channel vary.

Figure 11:
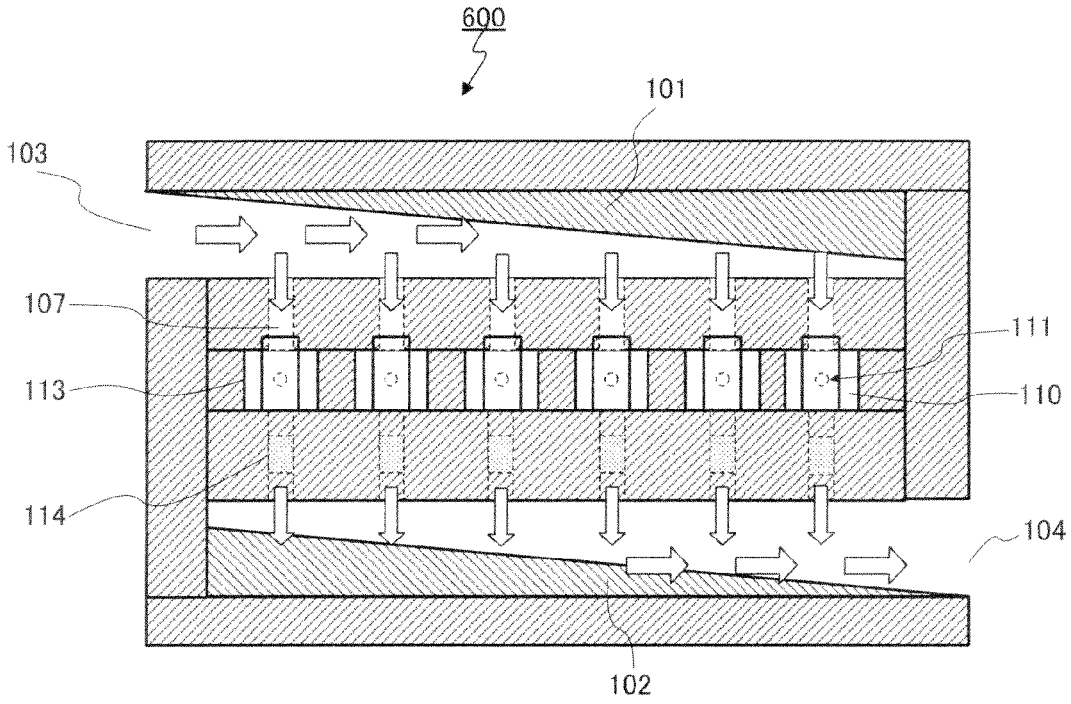
FIG. 11 is a cross-sectional view of an ink-jet apparatus of Embodiment 6.

FIG. 11 is a cross-sectional view of ink-jet apparatus 600 of Embodiment 6 taken along line B (see FIG. 2). As shown in FIG. 11, ink-jet apparatus 600 of this embodiment is the same as ink-jet apparatus 100 of Embodiment 1 except that ink supply channel 101 gradually narrows along the direction of the ink-flow, and ink evacuation channel 102 gradually widens along the direction of the ink-flow.

Ink flowing through ink supply channel 101 is supplied to ink chambers 110. Therefore, ink flowing inside ink supply channel 101 gradually decreases along the direction of the ink-flow. Consequently, if the cross-sectional area of ink supply channel 101 is constant, the ink pressure falls in the downstream direction of ink supply channel 101, and there is a risk of ink ceasing to be able to be supplied to ink chambers 110.

Also, ink flowing through ink evacuation channel 102 gradually increases in the direction of the ink-flow. Consequently, if the cross-sectional area of ink evacuation channel 102 is constant, the ink pressure increases in the downstream direction of ink supply channel 101, and there is a risk of ink ceasing to be able to be evacuated from ink chambers 110.

However, gradually narrowing ink supply channel 101 in the direction of the ink-flow and gradually widening ink evacuation channel 102 in the direction of the ink-flow, as in this embodiment, enables a uniform amount of ink to be supplied to all ink chambers 110, and a uniform amount of ink to be evacuated from all ink chambers 110.

(Reference Mode)

In Embodiments 1 through 6, modes have been described in which an ink-jet apparatus has first actuators and second actuators. In this reference mode, a mode will be described in which an ink-jet apparatus has only the first actuators.

Figure 12:
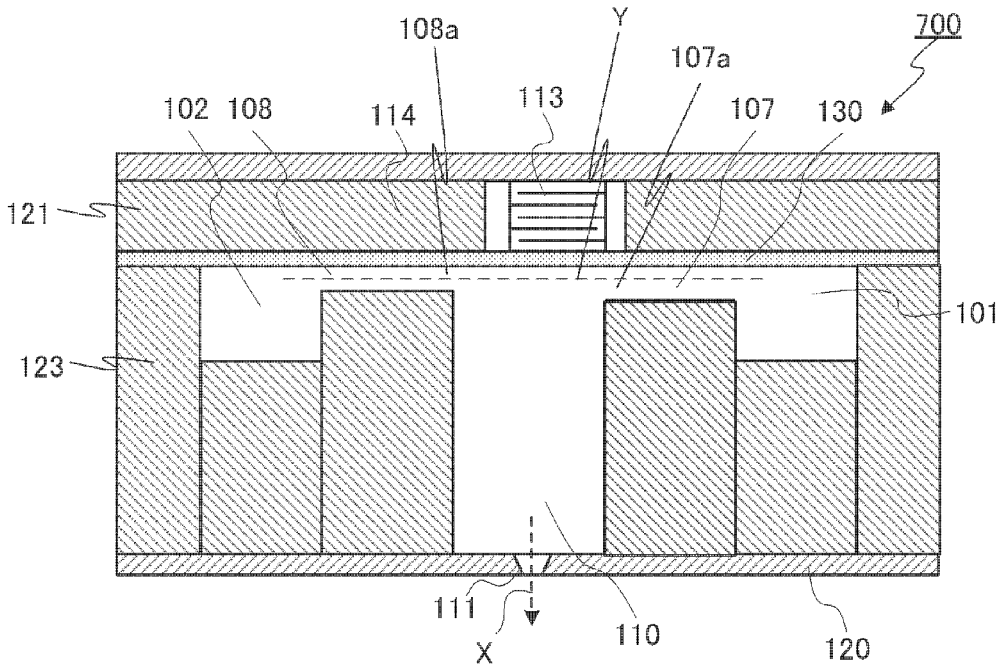
FIG. 12 is a cross-sectional view of an ink-jet apparatus of a reference mode.

FIG. 12 is a cross-sectional view of ink-jet apparatus 700 of this reference mode taken along line A (see FIG. 2). As shown in FIG. 12, an ink-jet apparatus of this reference mode is the same as ink-jet apparatus 400 of Embodiment 4 with the exception of not having the second actuator.

As shown in FIG. 12, in ink-jet apparatus 700, inlet connecting part 107*a* and outlet connecting part 108*a* are disposed opposite to each other. Also, in this embodiment, inlet connecting part 107*a* and outlet connecting part 108*a* are positioned in the vicinity of the top surface.

In this reference mode, ink inlet channel 107 and ink outlet channel 108 are rectilinear channels that do not curve. Furthermore, straight line Y passing through ink inlet channel 107 also passes through ink outlet channel 108.

Having ink inlet channel 107 and ink outlet channel 108 positioned in the same line in this way enables the smooth flow of ink from ink inlet channel 107 to ink outlet channel 108. As a result, the circulation of ink inside the ink-jet apparatus becomes smoother, and ink can be circulated within the ink-jet apparatus at a low circulation pressure even when high-viscosity ink is supplied.

INDUSTRIAL APPLICABILITY

An ink-circulating type of ink-jet apparatus of the present embodiments has great ink discharge force, enabling high-viscosity ink to be applied to an object of ink application in a stable fashion. Consequently, an ink-jet apparatus of the present embodiments is suitable for use as an ink-jet apparatus for application of an organic luminescent material in the manufacture of organic EL display panels, for example.

REFERENCE SIGNS LIST

100, 200, 300, 400, 500, 600, 700 Ink-jet apparatus
101 Ink supply channel
102 Ink evacuation channel
103 Ink inlet
104 Ink outlet
107 Ink inlet channel
107*a* Inlet connecting part
108 Ink outlet channel
108*a* Outlet connecting part
110 Ink chamber
111 Nozzle
112 Discharge aperture
113 First actuator
114 Second actuator
120 Nozzle plate
130, 140 Vibration plate
131 Punch holes

The invention claimed is:

1. An ink-jet apparatus comprising:

an ink supply channel configured to enable ink to flow therethrough;

an ink chamber configured to communicate with the ink supply channel via an ink inlet channel and hold the ink supplied from the ink supply channel, the ink chamber having a nozzle operable to discharge the ink;

an ink evacuation channel disposed apart from the nozzle, configured to communicate with the ink chamber via an ink outlet channel, and through which the ink held in the ink chamber is evacuated;

an ink circulating section configured to apply pressure to the ink so that the ink flows into the ink evacuation channel from the ink supply channel via the ink chamber;

a first actuator disposed on a wall of the ink chamber facing the nozzle across the ink chamber, the first actuator being operable to vibrate the wall of the ink chamber;

wherein, when a smallest cross-sectional area of the ink inlet channel is represented as S1, a smallest cross-sectional area of the ink outlet channel is represented as S2, and a cross-sectional area of the ink chamber which is perpendicular to a discharge direction of the ink is represented as S3, a relationship of S3>S1>S2 is satisfied, and a second actuator operable to change the smallest cross-sectional area S2 of the ink outlet channel.

2. The ink-jet apparatus according to claim 1, wherein:

the ink chamber comprises: a bottom surface formed by a nozzle plate in which the nozzle is provided, a top surface formed by a ceiling plate disposed opposite to the nozzle plate, and a side surface formed by a spacer disposed between the nozzle plate and the ceiling plate;

the ink-jet apparatus further comprising:

an outlet connecting part configured to connect the ink outlet channel and the ink chamber, and an inlet connecting part configured to connect the ink inlet channel and the ink chamber, the outlet connecting part and the inlet connecting part are provided at the side surface of the ink chamber;

wherein the outlet connecting part is disposed closer to the nozzle plate than the inlet connecting part is.

3. The ink-jet apparatus according to claim 1, wherein:

the ink chamber comprises: a bottom surface formed by a nozzle plate in which the nozzle is provided, a top surface formed by a ceiling plate disposed opposite to the nozzle plate, and a side surface formed by a spacer disposed between the nozzle plate and the ceiling plate; and the ink inlet channel and ink outlet channel are rectilinear;

the ink-jet apparatus further comprising:

an outlet connecting part configured to connect the ink outlet channel and the ink chamber and an inlet connecting part configured to connect the ink inlet channel and the ink chamber, the outlet connecting part and inlet connecting part are provided at the side surface of the ink chamber; and wherein the inlet connecting part and the outlet connecting part are disposed to be opposed to each other, and a straight line passing through the ink inlet channel also passes through the ink outlet channel.

4. The ink-jet apparatus according to claim 1, wherein the ink circulating section is a regulator.

5. The ink-jet apparatus according to claim 2, wherein the first actuator is disposed on the side surface of the ink chamber near a vicinity of the ceiling plate of the ink chamber.

6. The ink-jet apparatus according to claim 2, wherein the first actuator is disposed on the side surface of the ink chamber near a vicinity of the nozzle plate of the ink chamber.

7. The ink-jet apparatus according to claim 3, wherein the outlet connecting part and inlet connecting part are disposed near a vicinity of the top surface of the ink chamber.

8. The ink-jet apparatus according to claim 1, wherein a width of the ink supply channel gradually narrows along a direction of ink-flow therethrough and a width of the ink evacuation channel gradually widens along a direction of ink-flow therethrough.

9. The ink-jet apparatus according to claim 1, wherein:

the ink supply channel is configured to enable ink from an ink tank to flow therethrough; and the ink held in the ink chamber is evacuated through the ink evacuation channel so as to be circulated to the ink tank.

10. The ink-jet apparatus according to claim 1, wherein the ink circulating section is configured to make the ink held in the ink chamber circulate to the ink supply channel.

* * * * *